US009472901B2

(12) United States Patent
Wang

(10) Patent No.: US 9,472,901 B2
(45) Date of Patent: Oct. 18, 2016

(54) SHIELD CONNECTOR STRUCTURE

(71) Applicant: Yazaki Corporation, Tokyo (JP)

(72) Inventor: Feng Wang, Kakegawa (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 14/167,142

(22) Filed: Jan. 29, 2014

(65) Prior Publication Data

US 2014/0235104 A1 Aug. 21, 2014

(30) Foreign Application Priority Data

Feb. 20, 2013 (JP) ..... 2013-030749

(51) Int. Cl.

| | |
|---|---|
| ***H01R 9/03*** | (2006.01) |
| ***H01R 13/648*** | (2006.01) |
| ***H01R 13/6593*** | (2011.01) |
| ***H01R 13/6596*** | (2011.01) |
| *H01R 9/05* | (2006.01) |
| *H01R 13/52* | (2006.01) |
| *H01R 13/74* | (2006.01) |
| *H01R 101/00* | (2006.01) |

(52) U.S. Cl.

CPC ..... *H01R 13/648* (2013.01); *H01R 13/6593* (2013.01); *H01R 13/6596* (2013.01); *H01R 9/0518* (2013.01); *H01R 13/5205* (2013.01); *H01R 13/748* (2013.01); *H01R 2101/00* (2013.01); *H01R 2201/26* (2013.01)

(58) Field of Classification Search

CPC ..... H01R 4/646; H01R 13/658; H01R 4/02; H01R 9/05; H01R 9/0503; H02G 15/013

USPC ..... 439/98, 99, 607.41, 607.55, 607.52, 439/874; 174/74 R, 75 C, 78, 88 C

See application file for complete search history.

(56) References Cited

U.S. PATENT DOCUMENTS

| | | | | |
|---|---|---|---|---|
| 6,280,208 | B1 * | 8/2001 | Masuda et al. | 439/98 |
| 6,530,789 | B2 * | 3/2003 | Konda | 439/98 |
| 6,669,511 | B1 * | 12/2003 | Yagi et al. | 439/607.44 |
| 6,688,896 | B2 * | 2/2004 | Matsumoto | 439/98 |
| 6,793,532 | B2 * | 9/2004 | Saito et al. | 439/607.41 |

(Continued)

FOREIGN PATENT DOCUMENTS

| | | | |
|---|---|---|---|
| DE | 10016943 | A1 | 10/2000 |
| EP | 1965465 | A2 | 9/2008 |

(Continued)

OTHER PUBLICATIONS

Office Action dated on Dec. 23, 2015 issued for corresponding German Patent Application No. 10 2014 202 229.0.

*Primary Examiner* — Thanh Tam Le
(74) *Attorney, Agent, or Firm* — Locke Lord LLP

(57) ABSTRACT

A shield connector includes: a housing fixed to an outer surface of the metallic case; a shield member connecting a shield portion of a shield wire to the metallic case: a shield pipe as a pressure-bonding-member for swaging and connecting the shield portion and the shield member. The shield pipe includes: a tubular portion through which the shield wire and the shield member are inserted; a flange portion extended radially from the other side edge of the tubular portion; and a swage portion where the tubular portion is deformed to press the shield portion and the shield member 12.

2 Claims, 7 Drawing Sheets

(56) References Cited

U.S. PATENT DOCUMENTS

| | | | | |
|---|---|---|---|---|
| 7,268,297 | B2 | 9/2007 | Jeong | |
| 8,602,797 | B2 * | 12/2013 | Omae | 439/99 |
| 8,637,770 | B2 * | 1/2014 | Adachi et al. | 174/74 R |
| 8,808,012 | B2 * | 8/2014 | Omae et al. | 439/98 |
| 2007/0102185 | A1 | 5/2007 | Jeong | |
| 2012/0190238 | A1 | 7/2012 | Omae | |

FOREIGN PATENT DOCUMENTS

| | | | |
|---|---|---|---|
| JP | 2000175341 | A | 6/2000 |
| JP | 2000-294344 | A | 10/2000 |
| WO | WO-2012/029996 | A1 | 3/2012 |

* cited by examiner

SHIELD CONNECTOR STRUCTURE

CROSS REFERENCE TO RELATED APPLICATIONS

This application is on the basis of Japanese Patent Application No. 2013-030749, the contents of which are hereby incorporated by reference.

TECHNICAL FIELD

The present invention relates to a shield connector structure, in particular, a shield connector structure for connecting a shield wire inserted into an insertion hole penetrating from one side to the other side of a connection object with the connecting object.

BACKGROUND ART

Conventionally, in a vehicle (in particular, an electric vehicle or a hybrid vehicle), devices such as a motor, a battery; or an inverter are connected to each other with a shield wire, and a shield connector structure for connecting the shield wire and a case of the device to the ground is proposed (for example, see PTL 1). As shown in FIGS. 9, 10A, and 10B, a shield connector 10 described in PTL 1 is configured to connect a shield wire 1 with a metallic case 6 of a connection object, and to make a connection portion watertight. The shield wire 1 is a coaxial cable having a conductor 2, an inner insulating cover 3 covering a circumference of the conductor 2, a shield portion 4 composed of conductors such as a braided wire provided on a circumference of the inner insulating cover 3, and an outer insulating cover 5 coveting a circumference of the shield portion 4. The metallic case 6 is provided with an insertion hole 7 into with the shield wire 1 is inserted, and a bolt hole 8 screwed with a bolt 16 for fixing a housing 11.

This shield connector 10 includes: the housing 11 through which the shield wire 1 is inserted and fixed to the metallic case 6; a shield member 12 electrically connecting the shield portion 4 of the shield wire 1 with the metallic case 6; a first seal member 13 interposed between an inner surface of the shield member 12 and an outer surface of the outer insulating cover 5 of the shield wire 1; a second seal member 14 interposed between an outer surface of the shield member 12 and an inner surface of the insertion hole 7 of the metallic case 6; a shield pipe 15 connecting the shield member 12 and the shield portion 4 by swaging; the bolt 16 for fixing the housing 11 to the metallic case 6; and a rear holder 17 provided on one side of the housing 11 to hold the shield wire 1.

The housing 11 is fixed to one side (outer side) of the metallic ease 6, and holds the shield member 12 in between the metallic case 6 and the housing 11. The housing 11 includes: a housing main body 21; a fixation portion 22 fixed to the metallic case 6; a wire guide portion 23 through which the shield wire 1 is inserted; and a tubular projection 24 extended further to the other side (inner side) of the metallic case 6 than the wire guide portion 23 and inserted into the insertion hole 7.

A diameter of the shield member 12 is enlarged in three steps from the other side toward the one side of the metallic case 6, and the shield member 12 has a first tubular portion 31, a second tubular portion 32, a third tubular portion 33, and a connection portion 34 continued to the third tubular portion 33 and folded along one side surface (outer surface) of the metallic case 6. Further, when the first tubular portion 31 is connected to the shield portion 4 of the shield wire 1, and the connection portion 34 is sandwiched between an outer surface 6A as the one side surface of the metallic case 6 and an opposite surface 26 of the housing 11, the shield, portion is grounded with respect to the metallic case 6 via the shield member 12.

The shield pipe 15 includes: a tubular portion 41 through which the shield wire 1 and the first tubular portion 31 of the shield member 12 are inserted; a flange portion 42 extended outward in a radial direction from one side edge of the tubular portion 41; and a swage portion 44 in which a part of the tubular portion 41 is deformed inward in a radial direction to press the shield portion 4 and the first tubular portion 31 of the shield member 12. After the shield wire 1 and the first tubular portion 31 of the shield member 12 are inserted through the swage portion 44 which is not deformed yet, the tubular portion 41 at the swage portion 44 is swaged and deformed using a swaging tool, and the swage portion 44 presses the shield portion 4 and the first tubular portion 31 of the shield member 12, thereby the shield, wire 1 and the shield member 12 are pressure-bonded together and electrically connected to each other.

The shield member 12 is attached to an end of the shield wire 1 by swaging the shield pipe 15 as described above, and the housing 11, the rear holder 17, and the first and second seal members 13, 14 are attached to the end of the shield wire 1. Then, the shield wire 1 is inserted into the insertion hole 7 of the metallic case 6 from the other end (terminal 9 side) of the shield wire 1. Then, the connection portion 34 of the shield member 12 is sandwiched between the fixation portion 22 of the housing 11 and the outer surface 6A of the metallic case 6, and the holt 6 penetrating a through-hole 25 is screwed with the bolt hole 8 of the metallic case 6, thereby the housing 11 is fixed to the metallic case 6. In this way, when the connection portion 34 of the shield member 12 closely contacts the outer surface 6A of the metallic case 6, the shield portion 4 of the shield wire 1 is electrically connected to and grounded together with the metallic case 6 via the shield member 12, and thus the shield connector 10 is assembled.

CITATION LIST

Patent Literature

PTL 1: JPA, 2000-294344

SUMMARY OF INVENTION

Technical Problem

However, according to the conventional shield connector structure, when the shield portion 4 of the shield wire 1 and the shield member 12 are pressure-bonded together by swaging the shield pipe 15, if the swage portion 44 of the shield. pipe is displaced, the swage portion 44 may excessively bite into the shield wire 1, and the shield wire 1 may be damaged. In particular, as shown in FIG. 11, when the swage portion 44 of the shield pipe 15 is displaced toward the other side, a tip edge of the tubular portion 41 is bent inward in a radial direction, and this tip edge may bite into the shield wire 1 to damage the conductor 2 or the inner insulating cover 3.

In view of the above, an object of the present invention is to provide a shield connector structure able to surely prevent a shield wire from being damaged.

Solution to Problem

For attaining the object, according to a first aspect of the present invention, there is provided a shield connector structure for connecting a shield wire having a conductor, an inner insulating cover, a shield portion, and an outer insulating cover to a connection object by inserting the shield wire through an insertion hole of the connection object from one side to the other side, said shield connector structure including:

a housing fixed to one side of the connection object, and through which the shield wire is inserted;

a shield member for electrically connecting the shield portion of the shield wire with the connection object; and a pressure-bonding member for connecting the shield portion with the shield member by swaging, wherein the pressure-bonding member includes:

tubular portion through which the shield wire and the shield member are inserted;

a flange portion extended radially from the other side edge of the tubular portion; and a swage portion where a part of the tubular portion is deformed inwardly in a radial direction to press the shield portion and the shield member.

According to a second aspect of the present invention, there is provided the shield connector structure as described in the first aspect, wherein the shield portion of the shield wire includes:

a folded portion where the other side of the outer insulating cover is peeled and the shield portion is folded back; and an exposed portion extended toward the one side from the folded portion, covering the outer insulating cover, and connected to the shield member, wherein the flange portion of the pressure-bonding member includes:

an inner flange extended inward in a radial direction and extended toward the other side from the folded portion and covering the folded portion; or an outer flange extended outward in a radial direction and extended toward the one side from the folded portion.

According to a third aspect of the present invention, there is provided the shield connector structure as described in the second aspect, wherein the flange portion includes a circular extension portion extended from an inner edge of the inner flange toward the other side.

Advantageous Effects of Invention

According to the invention described in the first aspect, because the pressure-bonding-member includes a flange portion extended radially from the other side edge of the tubular portion, the rigidity of the other side edge of the tubular portion is increased, and the other side edge of the tubular portion is prevented from being deformed excessively when the swage portion as a part of the tubular portion is deformed to press the shield portion and the shield member. Therefore, the shield wire is surely prevented from being damaged when the edge of the pressure-bonding member bites into the shield wire.

According to the invention described in the second aspect, if the flange portion of the pressure-bonding member includes an inner flange extended inward in a radial direction and further toward the other side than the folded portion, when the inner flange covers the folded portion of the shield portion composed of such as a braided wire, the braided wire is prevented from being loosen, and the shield portion is prevented from being crowded out toward the other side. Alternatively, if the flange portion of the pressure-bonding member includes an outer flange extended outward in a radial direction and further toward the one side than the folded portion, the exposed portion of the shield portion can be smoothly guided along a curved surface from the outer flange to the swage portion, and the exposed portion bent by swaging is prevented from being damaged.

According to the invention described in the third aspect, because the flange portion includes a circular extension portion extended from an inner edge of the inner flange toward the other side, the folded portion of the shield portion can be protected by covering with the inner flange and the extension portion, and the shield portion is further surely prevented from being damaged.

These and other objects, features, and advantages of the present invention will become more apparent upon reading of the following detailed description along with the accompanied drawings.

DESCRIPTION OF EMBODIMENTS

Hereinafter, a shield connector structure according to an embodiment of the present invention will be explained with reference to FIGS. 1 to 5. The shield connector structure of this embodiment grounds a shield wire 1 when the shield wire 1 connects a motor and an inverter, an inverter and a battery, or the like used in a vehicle, in particular, an electric vehicle driven by an electric motor or a hybrid vehicle driven by both an engine and the electric motor.

Figure 1:
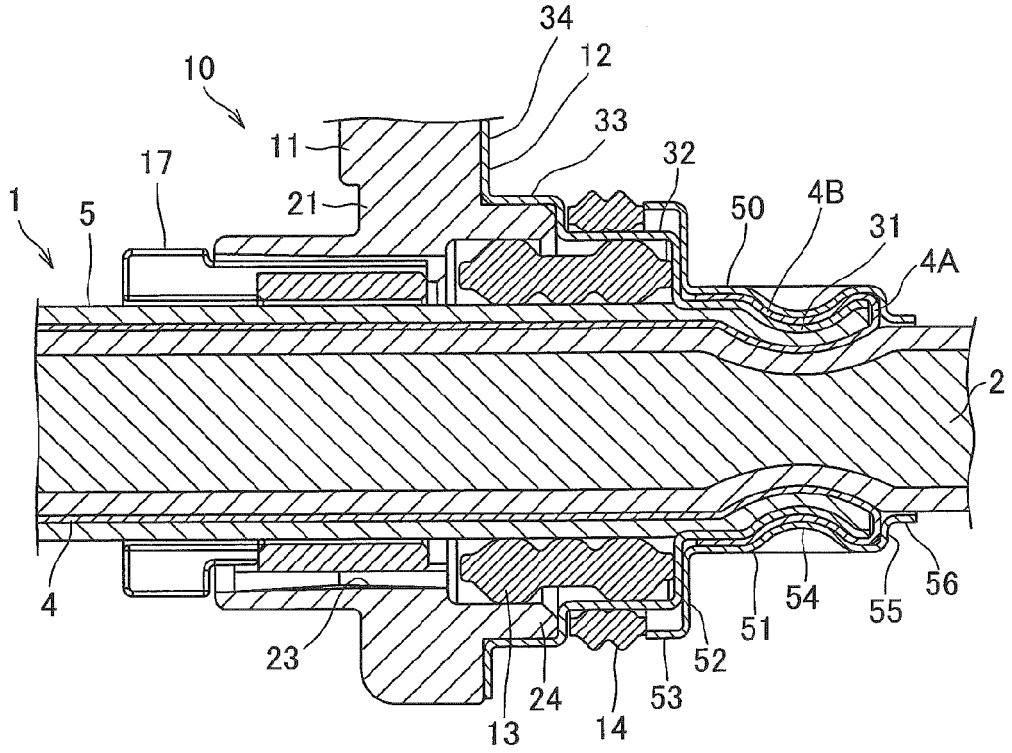
FIG. 1 is a sectional view showing a shield connector structure according to an embodiment of the present invention.

As shown in FIG. 1, the shield wire 1 is a coaxial cable including a conductor 2 as a twisted wire defined by twisting a plurality of element wires; an inner insulating cover 3 defined by insulating synthetic resin or the like covering a periphery of the conductor 2; a shield portion 4 defined by a braided wire or the like provided on a periphery of the inner insulating cover 3; and an outer insulating cover 5 defined by insulating synthetic resin or the like covering a periphery of the shield portion 4. Similar to the conventional art shown in FIG. 9, the connection object includes a metallic case 6 defining an outer shell of the connection object, and the metallic case 6 is provided with an insertion hole 7 for inserting the shield wire 1.

Figure 2:
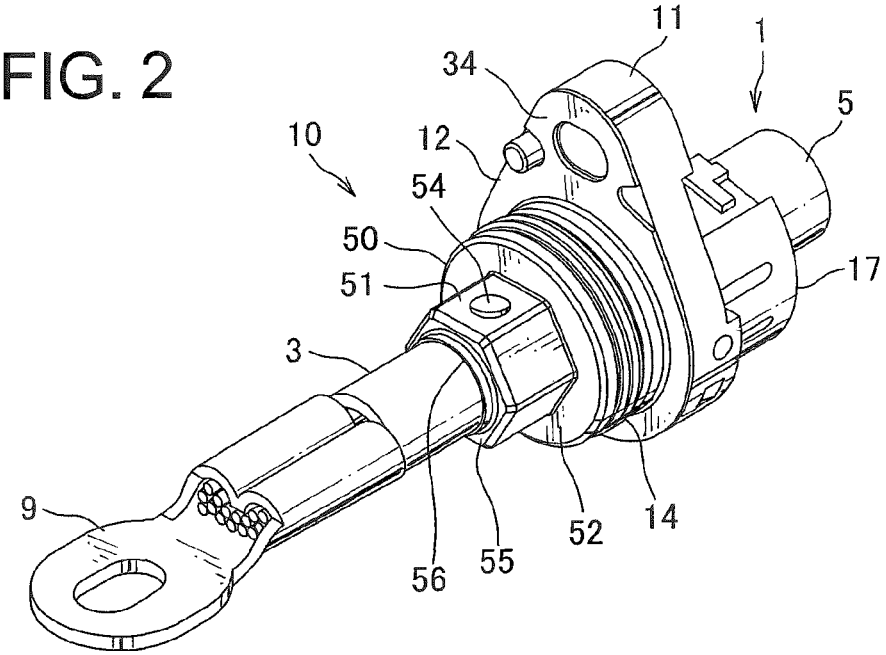
FIG. 2 is a perspective view showing a shield wire of the shield connector structure.
Figure 3:
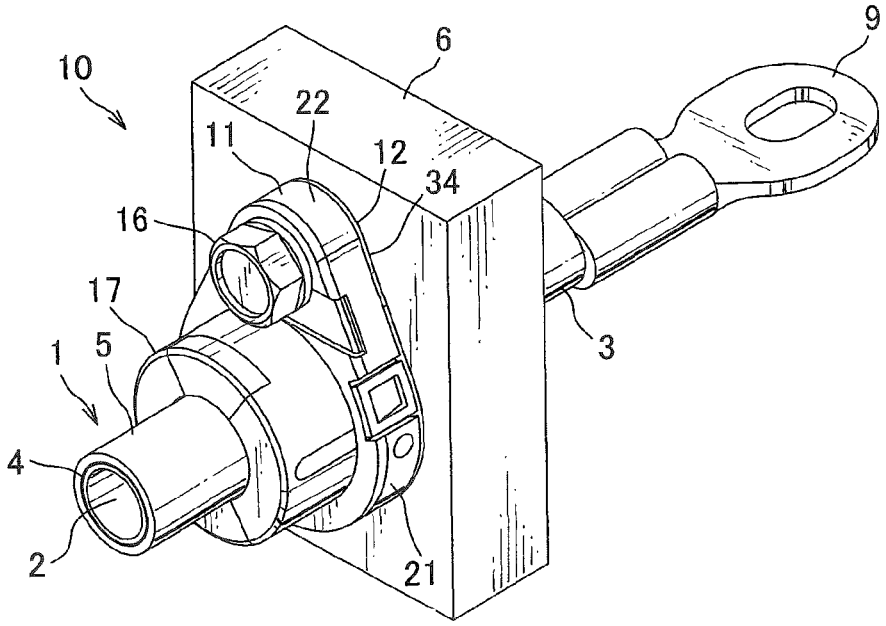
FIG. 3 is a perspective view showing the shield connector structure seeing from one side of a connection object.

The shield wire 1 is inserted from an outer side (one side) of the metallic case 6 via the insertion hole 7 to an inner side (the other side) of the metallic case 6, and as shown in FIGS. 2 and 3, a terminal 9 is fixed to the conductor 2 at an inner tip of the shield wire 1. This terminal 9 is connected to a not-shown electric connection portion in the metallic case 6. Further, a tip of the shield portion 4 of the shield wire 1 is exposed by removing the outer insulating cover 5, and the shield portion 4 includes: a folded portion 4A folded at a tip edge of the removed, outer insulating cover 5; and an exposed portion 4B extended from the folded portion 4A toward the one side and coveting the outer insulating cover 5. This exposed portion 4B is connected to a shield member 12. In this way the shield portion 4 is grounded by the metallic case 6 via the shield member 12, and electromagnetic waves are shielded by the shield portion 4 and the shield member 12 to prevent a leak or an intrusion of noise from the connection portion.

Similar to the conventional art, the shield connector 10 includes: a housing 11 through which the shield wire 1 is inserted and fixed to an outer surface of the metallic case 6; the conductive tubular shield member 12 connecting the shield portion 4 of the shield wire 1 to the metallic case 6; a first seal member 13 interposed between an inner surface of the shield member 12 and an outer surface of the outer insulating cover 5 of the shield wire 1; a second seal member 14 interposed between an outer surface of the shield member 12 and an inner surface of the insertion hole 7 of the metallic case 6; a circular shield pipe 50 (pressure bonding member) for swaging and fixing the shield portion 4 of the shield wire 1 and the shield member 12; a bolt 16 for fixing the housing 11 to the metallic case 6; and a rear holder 17 provided on the one side of the housing 11 to hold the shield wire 1.

Figure 9:
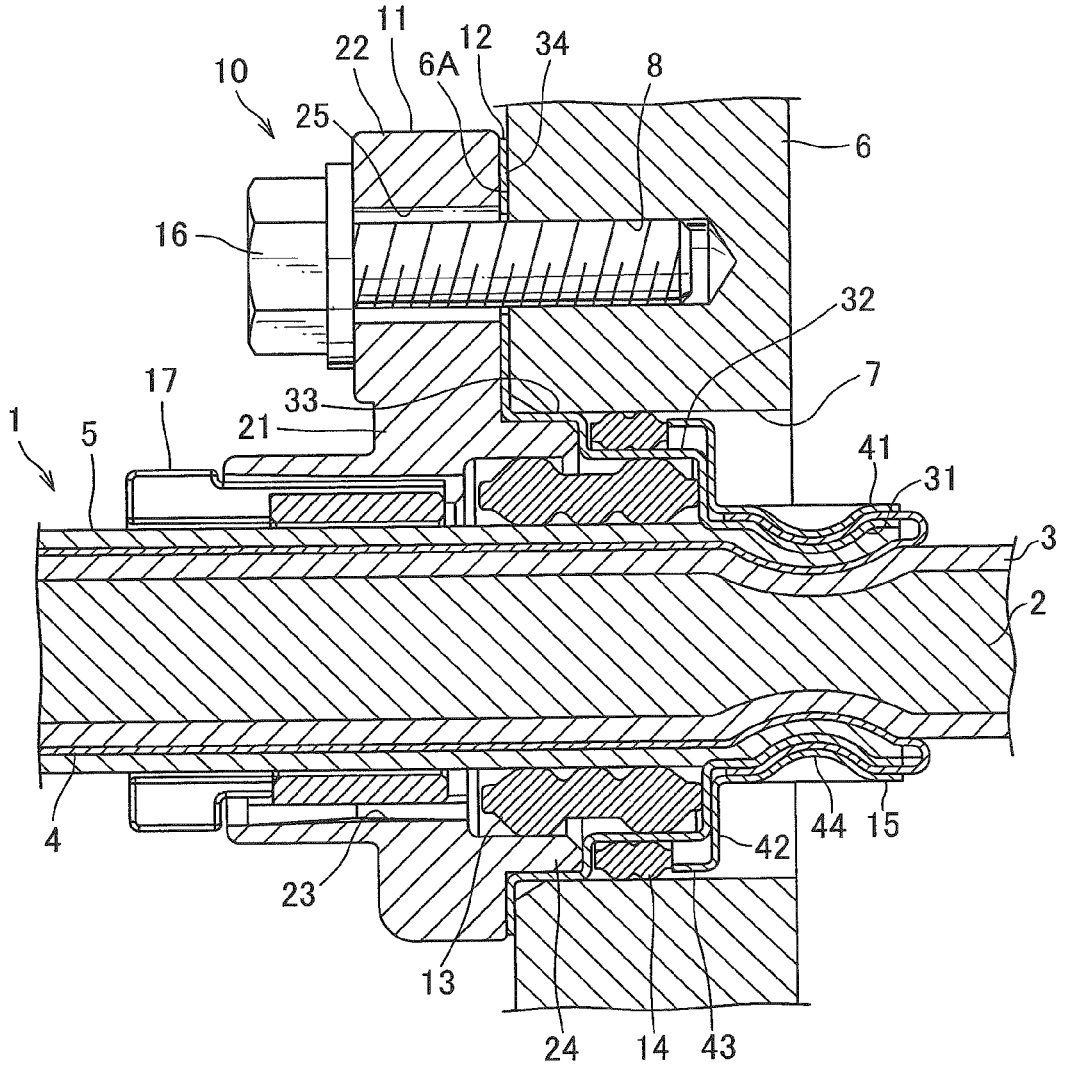
FIG. 9 PRIOR ART
FIG. 9 is a sectional view showing a conventional shield connector structure.
Figure 10A:
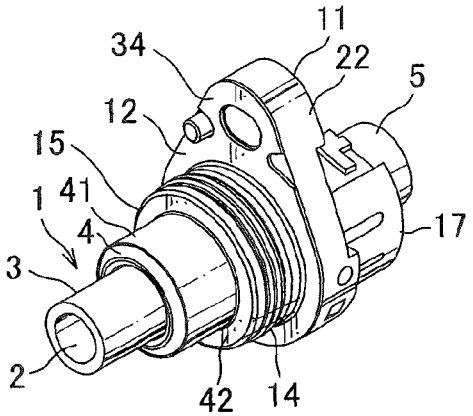
FIG. 10A PRIOR ART
FIG. 10A is a perspective view showing a pressure-bonded portion according to the conventional shield connector structure.
Figure 10B:
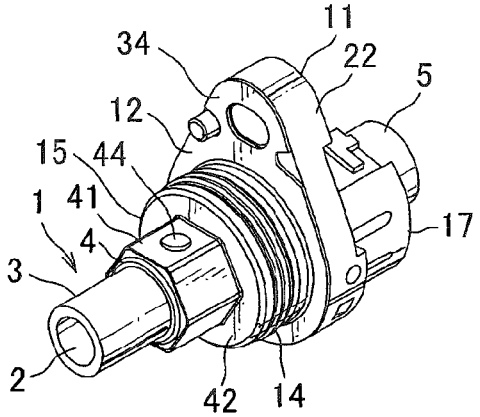
FIG. 10B PRIOR ART
FIG. 10B is a perspective view showing a pressure-bonded portion according to the conventional shield connector structure.
Figure 11:
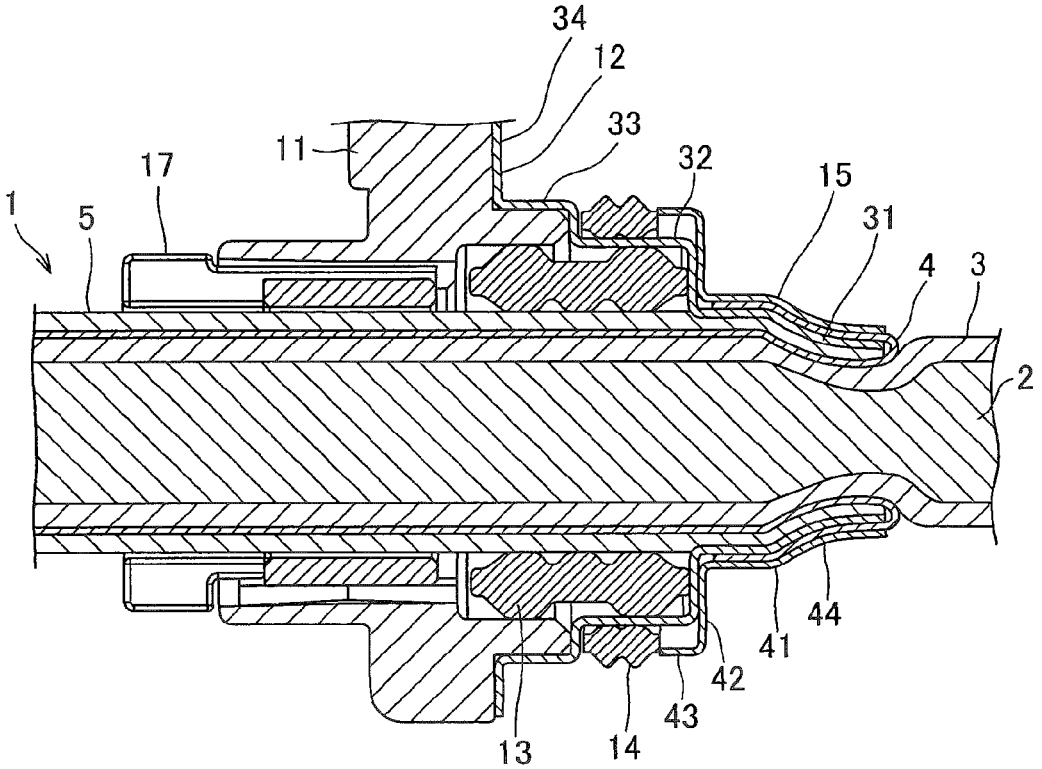
FIG. 11 PRIOR ART
FIG. 11 is a sectional view showing a defect example of the conventional pressure-bonded portion.

Here, the housing 11, the shield member 12, the first seal member 13, the second seal member 14, the bolt 16, and the rear holder 17 are the same as those of the shield connector according to the conventional art shown in FIGS. 9 to 11, and a configuration of the shield pipe 50 is different from the conventional art. Hereinafter, the same components as the conventional art are denoted by the same reference signs, and the explanations thereof are omitted or simplified. Points different from the conventional art will be explained particularly.

The housing 11 is a die-cast component integrally molded from metal such as aluminum alloy, and includes: a housing main body 21; a fixation portion 22; a wire guide portion 23; a tubular projection 24; and a through-hole 25 for inserting the bolt 16. Incidentally, the housing 11 is not limited to be made of metal, and may be made of synthetic resin as long as the housing can bold the shield member 12 and the first seal member 13. The shield member 12 includes: a first tubular portion 31, a second tubular portion 32, a third tubular portion 33, and a connection portion 34.

The first seal member 13 is made of elastic material such as gum, formed in totally a tubular shape, and has three circular lips provided on an inner periphery and two circular lips provided on an outer periphery of the first seal member 13. When the three circular lips on the inner periphery of the first seal member 13 closely contact an outer periphery of the outer insulating cover 5, and the two circular lips on the outer periphery of the first seal member 13 closely contact an inner periphery of the tubular projection 24 and an inner periphery of the second tubular portion 32 of the shield member 12, a gap between the shield wire 1 and the housing 11 and a gap between the shield wire 1 and the shield member 12 are sealed.

The second seal member 14 is made of elastic material such as gum, formed in totally a tubular shape, and has two circular lips provided on an inner periphery and two circular lips provided on an outer periphery of the second seal member 14. When the two circular lips on the inner periphery of the second seal member 14 closely contact an outer periphery of the second tubular portion 32, and the two circular lips on the outer periphery of the second seal member 14 closely contact an inner periphery of the insertion hole 7, a gap between the shield member 12 and the metallic case 6 is sealed. As described above, in an inside of the insertion hole 7, the first seal member 13, the tubular projection 24 of the housing 11 and the second tubular portion 32 of the shield member 12, the second seal member 14 are sequentially positioned from the outer periphery of the outer insulating cover 5 to the inner periphery of the insertion hole 7. When they closely contact each other, the shield wire 1 is connected to the metallic case 6 while the shield wire is made watertight.

Figure 4A:
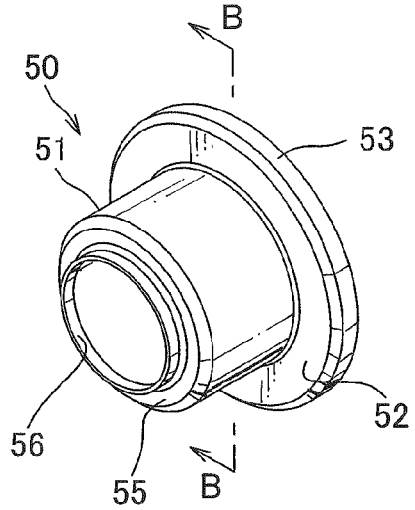
FIG. 4A is a perspective view showing a pressure-bonding member of the shield connector structure.
Figure 4B:
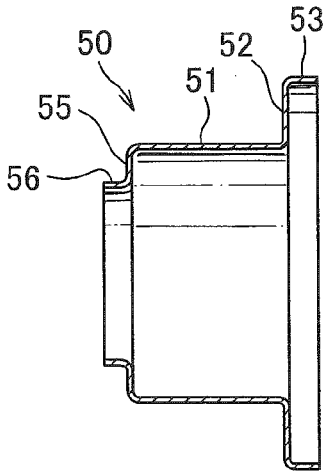
FIG. 4B is a sectional view showing the pressure-bonding member of the shield connector structure.
Figure 5:
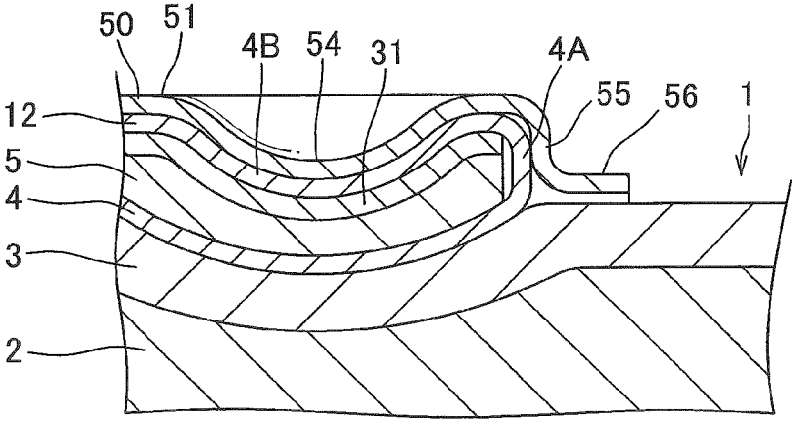
FIG. 5 is an enlarged sectional view showing a pressure-bonded portion with the pressure-bonding member of FIG. 4A.

As shown in FIGS. 4A, 4B, and 5, similar to the conventional shield pipe 15, the shield pipe 50 includes: a tubular portion 51 through which the shield wire 1. and the first tubular portion 31 are inserted; a flange portion 52 extended from the one side edge of the tubular portion 51 toward an outside in a radial direction; a folded portion 53 folded at an outer peripheral edge of the flange portion 52 and extended further toward the one side; and a swage portion 54 as a part of the tubular portion deformed inward in the radial direction to press the shield portion 4 and the first tubular portion 31 of the shield member 12. The shield pipe 50 further includes as a flange portion provided on the other side of the tubular portion 51: an inner flange 55 extended inward in the radial direction; and a circular extended portion 56 extended from an inner edge of the inner flange 55 toward the other side.

As shown in FIG. 5, the inner flange 55 is positioned nearer the other side (right side in FIG. 5, inner side of the metallic case 6) than the folded portion 4A of the folded shield portion 4, and covers the folded portion 4A. Further, the extended portion 56 is positioned further nearer the other side than the folded portion 4A, and extended along the inner insulating cover 3 of the shield wire 1. Because rigidity of an edge of the tubular portion 51 of such a shield pipe 50 is increased by the inner flange 55 and the extended portion 56, when the tubular portion 51 is swaged to form the swage portion 54 using the swaging tool, the inner flange 55 and the extended portion 56 are less deformed inward in a radial direction, and thereby they are prevented from biting into the shield wire 1. Further, when the inner flange 55 and the extended portion 56 cover the folded portion 4A of the shield portion 4, the shield portion 4 defined by the braided wire is prevented from being loosen, being crowded out, and the like.

Figure 6:
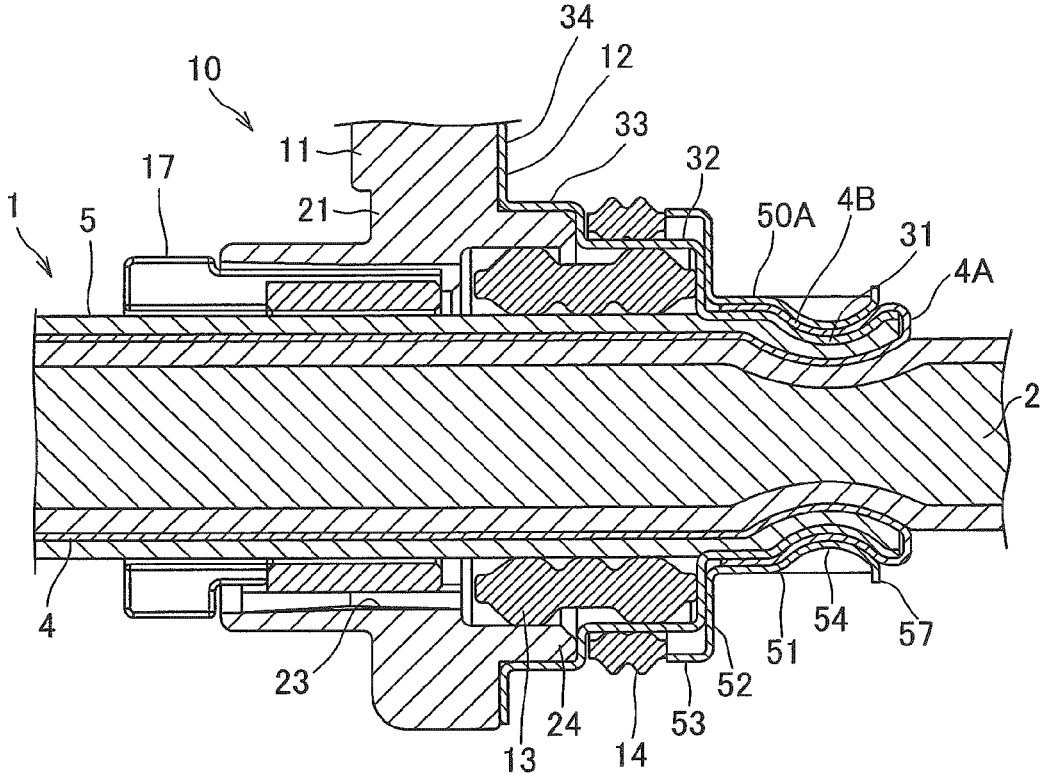
FIG. 6 is a sectional view showing a shield connector structure according to a modified embodiment of the present invention.
Figure 7A:
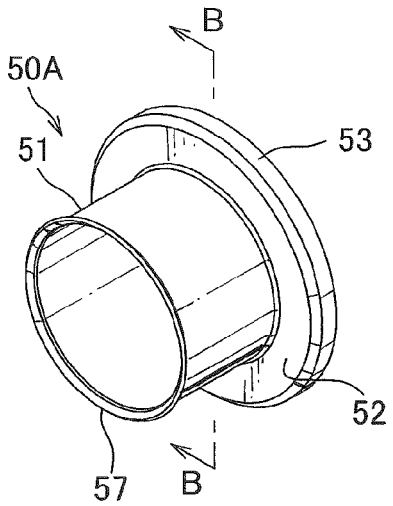
FIG. 7A is a perspective view showing a pressure-bonding member according to the modified embodiment.
Figure 7B:
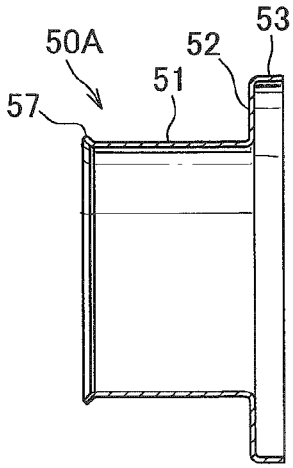
FIG. 7B is a sectional view showing the pressure-bonding member according to the modified embodiment.
Figure 8:
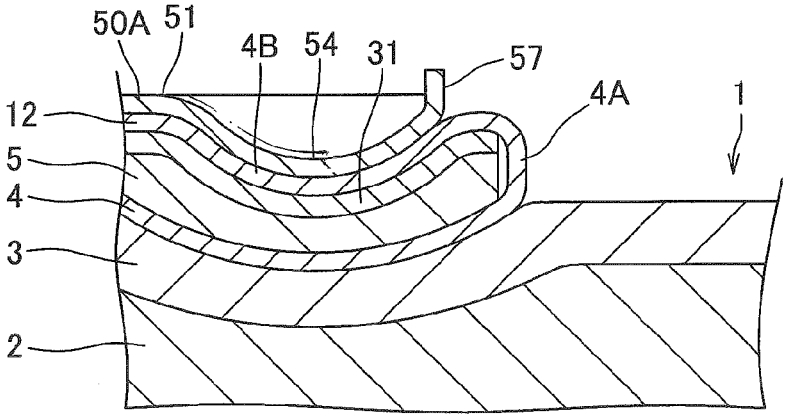
FIG. 8 is an enlarged sectional view showing a pressure-bonded portion with the pressure bonding member of FIG. 7A.

Incidentally, according to this embodiment, as shown in FIGS. 6 to 8, the shield connector 10 may be provided with a shield pipe 50A. Similar to the shield pipe 50, the shield pipe 50A includes: the tubular portion 51; the flange portion 52; the folded portion 53; and the swage portion 54, and further includes an outer flange 57 extended outward in a radial direction as a flange portion provided on the other side edge of the tubular portion 51. As shown in FIG. 3, the outer flange 57 is positioned nearer the one side (left side in FIG. 8, outer side of the metallic case 6) than the folded portion 4A of the shield portion 4. Because rigidity of an edge of the tubular portion 51 of such a shield pipe 50A is increased by the outer flange 57, when the swage portion 54 is formed, the outer flange 57 is less deformed inward in a radial direction, and thereby the outer flange 57 is prevented from biting into the shield wire 1. Further, the exposed portion 4B of the shield portion 4 can be smoothly guided along a curved surface from the outer flange 57 to the swage portion 54, and the exposed portion 4B bent by swaging is prevented from being damaged.

An assembling procedure of the above shield wire 1 to the metallic case 6 is, firstly, exposing the shield portion 4 by removing the outer insulating cover 5 at the tip of the shield wire 1 cut in a specific length, and sequentially inserting the tip into the rear holder 17, the housing 11, the first seal member 13, and the shield member 12, further, fitting the second seal member 14 onto the second tubular portion 32 of the shield member 12 from the tip side of the shield wire. Then, the shield portion 4 is folded at the folded portion 4A to cover the outer insulating cover 5 with the exposed portion 4B, the shield pipe 50 or 50A is inserted from the tip of the shield wire 1, the exposed portion 4B and the first tubular portion 31 of the shield member 12 are inserted into an interior of the tubular portion 51, and the flange portion 52 of the shield pipe 50 or 50A is pushed to abut on the shield member 12.

Then, the inner flange 55 and the extended portion 56 of the shield pipe 50 cover the folded portion 4A of the shield portion 4, or the outer flange 57 of the shield pipe 50A is positioned nearer the one side than the folded portion 4A, After the shield pipe 50 or 50A is attached in this way, the tubular portion 51 is swaged and deformed using the swaging tool to form the swage portion 54, and the swage portion 54 presses the exposed portion 4B of the shield portion 4 and the first tubular portion 31 of the shield member 12 to pressure-bonding and fixing the shield wire 1 and the shield member 12 to each other.

Next, the first seal member 13 is moved toward the tip of the shield wire 1 and press-fitted into a gap between the outer insulating cover 5 and the second tubular portion 32 of the shield member 12. Then, the housing 11 is moved toward the tip of the shield wire 1 and the tubular projection 24 of the housing 11 is inserted between the first seal member 13 and the third tubular portion 33 of the shield member 12, and the housing main body 21 and the fixation portion 22 of the housing 11 are made abut on the connection portion 34 of the shield member 12. Then, at the tip of the shield wire 1, the terminal 9 is pressure-bonded to the exposed conductor 2 made by removing the inner insulating cover 3.

According to the above, as shown in FIG. 2, the housing 11, the shield member 12, the first seal member 13, the second seal member 14, the shield pipe 50 or 50A and the rear holder 17 are attached to the tip of the shield wire 1. The shield wire 1 of this condition is inserted into the insertion hole 7 of the metallic case 6 from the terminal 9 side. Then, the connection portion 34 of the shield member 12 is sandwiched between the fixation portion 22 of the housing 11 and the outer surface 6A of the metallic case 6, and the housing 11 is fixed to the metallic case 6 with the bolt 16. Thereby, the shield member 12 is connected to the metallic case 6, and the assembling of the shield wire 1 is finished.

According to this embodiment as described above, because the shield pipe 50 or 50A includes as a flange portion the inner flange 55 and the extended portion 56, or the outer flange 57 on the other side edge of the tubular portion 51, the rigidity of the other side edge of the tubular portion 51 is increased, and the other side edge of the tubular portion 51 is prevented from being deformed excessively when the swage portion 54 is deformed to press the exposed portion 4B of the shield portion 4 and the first tubular portion 31 of the shield member 12. Therefore, the shield wire 1 is surely prevented from being damaged when the edge of the shield pipe 50 or 50A bites into the shield wire 1.

Incidentally, in the above embodiment, the coaxial cable is used as the shield wire 1, however, the present invention is also used in a shield connecter structure for connecting a shield wire having conductors composed of a plurality of core wires. In this case, the shield member, the first seal member, the second seal member, an extended portion of the housing, a tubular portion of the shield pipe as the pressure-bonding member may be formed in a tubular shape having an oval sectional shape or an oblong sectional shape. Further, the connection object is not limited to the motor, the inverter, and the battery used in an electric vehicle or a hybrid vehicle, and may he a proper electric device or an electrical junction box having electric components therein. Further, the shield wire is grounded by not limited to the metallic case 6, but may be grounded by a region which is grounded.

Further, according to the above embodiment, the shield pipe 50 or 50A as the pressure-bonding member includes: the flange portion 52 and the folded portion 53. However, these portions can be omitted and the shape of the shield pipe 50 or 50A is not specifically limited. Further, according to the above embodiment, the swage portion 54 is formed at a position where the tubular portion 51 of the shield pipe 50 or 50A is opposite to itself in a radial direction. However, the present invention is not limited to this. The swage portion 54 may be formed in a groove shape continued in a circumferential direction, or may he formed at three positions in a proper interval along the circumferential direction. Further, according to the above embodiment, the shield connector 10 includes: the first seal member 13; the second seal member 14; and the rear holder 17. However, these components are not necessary for the present invention, and can be omitted or replaced with the other component properly.

The invention has been described in connection with what are presently considered to be the most practical and preferred embodiments. However, the present invention has been presented by way of illustration and is not intended, to be limited to the disclosed embodiments. Accordingly, those skilled in the art will realize that the invention is intended to encompass all modifications and alternative arrangements included within the spirit and scope of the invention, as set forth by the appended claims.

REFERENCE SIGNS LIST

1 shield wire
2 conductor
3 inner insulating cover
4 shield portion
4A folded portion

4B exposed portion
5 outer insulating cover
6 metallic case (connection object)
6A outer surface (one side surface)
7 insertion hole
8 bolt hole
10 shield connector
11 housing
12 shield member
50, 50A shield pipe (pressure-bonding member)
51 tubular portion
54 swage portion
55 inner flange (flange portion)
56 extended portion (flange portion)
57 outer flange (flange portion)

What is claimed is:

1. A shield connector structure for connecting a shield wire having a conductor, an inner insulating cover, a shield portion, and an outer insulating cover to a connection object by inserting the shield wire through an insertion hole of the connection object from one side to the other side, said shield connector structure comprising:

a housing fixed to one side of the connection object, and through which the shield wire is inserted;

a shield member for electrically connecting the shield portion of the shield wire with the connection object; and a pressure-bonding member for connecting the shield portion with the shield member by swaging, wherein the pressure-bonding member includes:

a tubular portion through which the shield wire and the shield member are inserted;

a flange portion extended radially from the other side edge of the tubular portion; and a swage portion where a part of the tubular portion is deformed inwardly in a radial direction to press the shield portion and the shield member, wherein the flange portion is disposed within the pressure-bonding member proximate the other side relative to the swage portion, wherein the shield portion of the shield wire includes:

a folded portion where the other side of the outer insulating cover is peeled and the shield portion is folded back; and an exposed portion extended toward the one side from the folded portion, covering the outer insulating cover, and connected to the shield member, wherein the flange portion of the pressure-bonding member includes:

an inner flange extended substantially perpendicular to the shield wire and covering the folded portion; and a circular extension portion extended from one end of the inner flange toward the other side along the shield wire.

2. The shield connector structure as claimed in claim 1, wherein the circular extension portion extends along the inner insulating cover.

* * * * *